US005645933A

United States Patent [19]

Sakazume et al.

[11] Patent Number: 5,645,933

[45] Date of Patent: Jul. 8, 1997

[54] POLYPROPYLENE MONOAXIALLY ORIENTED MATERIAL, WOVEN OR NON-WOVEN FABRIC, LAMINATED PRODUCT AND PREPARATION METHOD

[75] Inventors: Suehiro Sakazume, Imba-gun; Tsutomu Miyamoto, Kita Soma-gun; Hiroshi Shimizu, Sakura, all of Japan

[73] Assignee: Nippon Petrochemicals Company, Limited, Tokyo, Japan

[21] Appl. No.: 425,369

[22] Filed: Apr. 20, 1995

[30] Foreign Application Priority Data

Apr. 22, 1994 [JP] Japan ..... 6-107966
Apr. 26, 1994 [JP] Japan ..... 6-110384

[51] Int. Cl.[6] ..... B32B 3/10; B32B 7/12

[52] U.S. Cl. ..... 442/290; 428/134; 428/136; 428/355; 442/398

[58] Field of Search ..... 428/136, 131, 428/134, 354, 355, 284, 286, 247, 516, 517

[56] References Cited

U.S. PATENT DOCUMENTS 3,300,366 1/1967 Krolik, Jr. ..... 428/136
3,730,821 5/1973 Jackson ..... 428/136 X
3,841,951 10/1974 Kim ..... 428/136 X
3,906,073 9/1975 Kim et al. ..... 264/147
3,985,600 10/1976 Blais .
4,259,385 3/1981 Keller ..... 428/136 X
5,032,442 7/1991 Yamazaki et al. ..... 428/136 X

FOREIGN PATENT DOCUMENTS 469 682 4/1974 Australia .

*Primary Examiner*—Daniel Zirker
*Attorney, Agent, or Firm*—Scully, Scott, Murphy & Presser

[57] ABSTRACT

A monoaxially oriented material of a longitudinally monoaxially oriented reticular web (a), a transversely monoaxially oriented reticular web (b) or a monoaxially oriented multi-layer tape (c) which comprises a polypropylene resin layer and an adhesive layer comprising a mixture of polypropylene resin and polyethylene resin and laminated on one surface or both surfaces of the polypropylene resin layer, and a polypropylene woven or non-woven fabric prepared by laminating crosswise or weaving the monoaxially oriented materials with interposing the adhesive layer so that the orientation axes of the materials may intersect; and a method for preparing the polypropylene woven or non-woven fabric and a heat-resistant reinforced laminate material.

10 Claims, 7 Drawing Sheets

Strand Strength Retained: ○ Exam. 10 ● Exam. 11

Elongation Retained: △ Exam. 10 ▲ Exam. 11

Adhesive Strength Retained: □ Exam. 10 ■ Exam. 11

POLYPROPYLENE MONOAXIALLY ORIENTED MATERIAL, WOVEN OR NON-WOVEN FABRIC, LAMINATED PRODUCT AND PREPARATION METHOD

BACKGROUND OF THE INVENTION (1) Field of the Invention

The present invention relates to a monoaxially oriented polypropylene material which is excellent in the properties of moldability in the film fabrication process, fibrillation property after the orientation of the film, and also heat resistance, tear resistance, adhesive strength and so forth.

More particularly, the present invention relates to a woven or non-woven fabric made of the above material and a heat-resistant reinforced laminate material comprising the monoaxially oriented polypropylene material or the woven or non-woven fabric and a base material which are bonded together and which laminate material has excellent heat resistance and tear resistance. Furthermore, the present invention relates to a method for producing the above-mentioned woven or non-woven fabric and laminate material.

(2) Description of the Prior Art

There has been proposed a non-woven fabric which is prepared by laminating reticular webs formed by fibrillating longitudinally and monoaxially oriented multi-layer webs, and a woven fabric or a non-woven fabric which is prepared by crosswise laminating or weaving longitudinally and monoaxially oriented multi-layer tapes (hereinafter referred to as "woven or non-woven fabric"). They are practically produced using high-density polyethylene as disclosed, for example, in British Patent 47112/72 and U.S. Pat. No. 3,985,600.

More particularly, the woven or non-woven fabric made of high-density polyethylene is made by laminating low-density polyethylene layers on both surfaces of a high-density polyethylene film, then orienting the laminated films and fibrillating the film to obtain reticular webs. The fibrillated webs are laminated crosswise in which the axes of orientation intersect with each other, and then they are thermally bonded. These woven and non-woven fabrics have been utilized as agricultural and gardening materials as well as building materials such as covering materials for agriculture, green covers for a golf course, filters, bags for draining or other various uses, oil adsorbents, flower wraps and house wraps.

In recent years, however, with the tendency of increasing uses, the reduction in cost and the improvement in heat resistance, tear resistance, adhesive strength and so forth are demanded. In order to meet these demands, it is desired to develop a polypropylene non-woven fabric which has higher heat resistance than that of polyethylene non-woven fabric. As a heat-sealing layer (adhesive layer) for the polypropylene non-woven fabric, a propylene-ethylene random copolymer has usually been used. However, when the propylene-ethylene random copolymer is used as the adhesive layer, several troubles occur in various steps of production process such as a film fabricating step and a fibrillating step and the troubles inhibit the long and stable operation. In addition, there is a disadvantage that the final product of non-woven fabric having high adhesive strength and heat resistance cannot be obtained. Furthermore, in a reinforced laminate comprising a base material and a woven or non-woven fabric, when a polyethylene fabric is used, the formed laminate is poor in heat resistance.

Moreover, in the case of a polypropylene non-woven fabric using propylene-ethylene random copolymer as an adhesive layer, the film fabricating property, fibrillation property, adhesive strength between webs forming the non-woven fabric and heat resistance are not sufficient.

Nowadays, with the increase of the use of woven and non-woven fabrics for draining bags in kitchens, agricultural materials and so forth, other additional properties such as the improvement in coloring and weather resistance of woven or non-woven fabrics are demanded. However, when a pigment and an weatherproofing agent are added to woven or non-woven fabric, scum or the like is accumulated on the parts of a fibrillator in a fibrillating step, so that it is undesirable in that unsplit portions and white powder are formed.

Meanwhile, with regard to the reinforced laminate comprising a woven or non-woven fabric and a base material, it is desired to improve its strength and heat resistance.

SUMMARY OF THE INVENTION

The present inventors have carried out intensive investigations to solve the above-mentioned problems. As a result, it has been found out that a specific polypropylene woven or non-woven fabric can solve the troubles in the steps of film fabrication and fibrillation in the manufacturing process, and can give excellent tear resistance, adhesive strength and other properties. And it can be applicable to the improvement of the adhesive layer of a multi-layer film fabricated by using a highly crystalline polypropylene base and also applicable to the coloring of a web. In consequence, the present invention has been accomplished.

The first object of the present invention is to provide a polypropylene woven or non-woven fabric which is excellent in heat resistance, tear resistance and adhesive strength.

The second object of the present invention is to eliminate the troubles in production steps such as a film fabricating step and a fibrillation step in the manufacturing process of woven or non-woven fabric. In other words, in this second object of the present invention, the film fabricating property such as the stabilization of bubble is attained in the film fabricating step, the uneven orienting and tearing are avoided in an orientation step, the formation of unsplit portions or incompletely fibrillated portions are avoided in the fibrillation step or a slitting step, and other defects such as the spreading of splits, the occurrence of unsplit portions or formation of white powder due to the accumulation of scums on a fibrillator are avoided when a pigment or an weatherproofing agent is used, and the lowering of adhesive strength of the product of woven or non-woven fabric.

The third object of the present invention is to provide a monoaxially oriented film, a woven or non-woven fabric and a reinforced laminate comprising the woven or non-woven fabric and a base material, which laminate has excellent adhesive strength and heat resistance.

The first aspect of the present invention is directed to at least one of the following monoaxially oriented materials of (a), (b) and (c) which comprises a polypropylene resin layer (I) and an adhesive layer (II). The adhesive layer (II) comprises a mixture of polypropylene and polyethylene and laminated on one surface or both surfaces of the resin layer (I). Further provided in the first aspect of the invention are a polypropylene woven or non-woven fabric prepared by weaving of laminating crosswise the monoaxially oriented materials with interposing the adhesive layer (II) thereof so that the axes of orientation of the films intersect with each other:

Monoaxially oriented material (a) a longitudinally monoaxially oriented reticular web, (b) a transversely monoaxially oriented reticular web, and (c) a monoaxially oriented multi-layer tape.

The second aspect of the present invention is directed to a method for preparing a polypropylene non-woven fabric which comprises the steps of preparing a multi-layer film by laminating a polypropylene resin layer (I) obtained by extrusion and an adhesive layer (II) of a mixture of polypropylene and polyethylene on one surface or both surfaces of the polypropylene resin layer (I); monoaxially orienting the multi-layer film in parallel with the longitudinal direction of the multi-layer film; fibrillating the monoaxially oriented multi-layer film in parallel with the orientation axis; spreading the monoaxially oriented multi-layer film to obtain a longitudinally monoaxially oriented reticular web (a); feeding the longitudinally monoaxially oriented reticular web (a); feeding another longitudinally monoaxially oriented reticular web (a') at right angles to the running direction of the former longitudinally monoaxially oriented reticular web (a), the longitudinally monoaxially oriented reticular web (a') being previously cut so as to have a length equal to the width of the longitudinally monoaxially oriented reticular web (a); and then thermally bonding the webs (a) and (a') together, while the webs are crosswise laminated with their orientation axes may intersect with each other.

The third aspect of the present invention is directed to a method for preparing a polypropylene non-woven fabric which comprises the steps of:

preparing a multi-layer film by laminating a polypropylene resin layer (I) obtained by extrusion and an adhesive layer (II) of a mixture of polypropylene and polyethylene on one surface or both surfaces of the polypropylene resin layer (I); slightly orienting if need be; slitting the multi-layer film in the transversal direction; monoaxially orienting the slit film to obtain a transversally monoaxially oriented reticular web (b); feeding the transversely monoaxially oriented reticular web (b) at a constant rate;

meanwhile, preparing a multi-layer film by laminating a polypropylene resin layer (I) obtained by extrusion and an adhesive layer (II) of a mixture of polypropylene and polyethylene on one surface or both surfaces of the polypropylene resin layer (I); monoaxially orienting the multi-layer film in parallel with the longitudinal direction of the multi-layer film; fibrillating the monoaxially oriented multi-layer film in parallel with the orientation axis; spreading the monoaxially oriented multi-layer film to obtain a longitudinally monoaxially oriented reticular web (a); laminating together the longitudinally monoaxially oriented reticular web (a) with the former transversally monoaxially oriented reticular web (b) with interposing the adhesive layer (II) therebetween.

The fourth aspect of the present invention is directed to a heat-resistant reinforced laminate obtained by laminating a base material (M) and at least one monoaxially oriented film (F) selected from the following (a), (b) and (c), which film (F) comprises a polypropylene resin layer (I) and an adhesive layer (II) of a mixture of a polypropylene resin arid a polyethylene resin laminated on one surface or both surfaces of the layer (I); or a polypropylene non-woven fabric (F1) or woven fabric (F2) obtained by laminating crosswise or weaving the monoaxially oriented films with interposing the adhesive layer (II) so that the orientation axes of the films may intersect with each other:

Monoaxially oriented material (a) a longitudinally monoaxially oriented reticular web, (b) a transversely monoaxially oriented reticular web, and (c) a monoaxially oriented multi-layer tape.

BRIEF DESCRIPTION OF THE DRAWINGS

These and other objects and features of the present invention will become more apparent in the following description with reference to several embodiments and accompanying drawings, in which.

DETAILED DESCRIPTION OF THE INVENTION

Figure 1A:
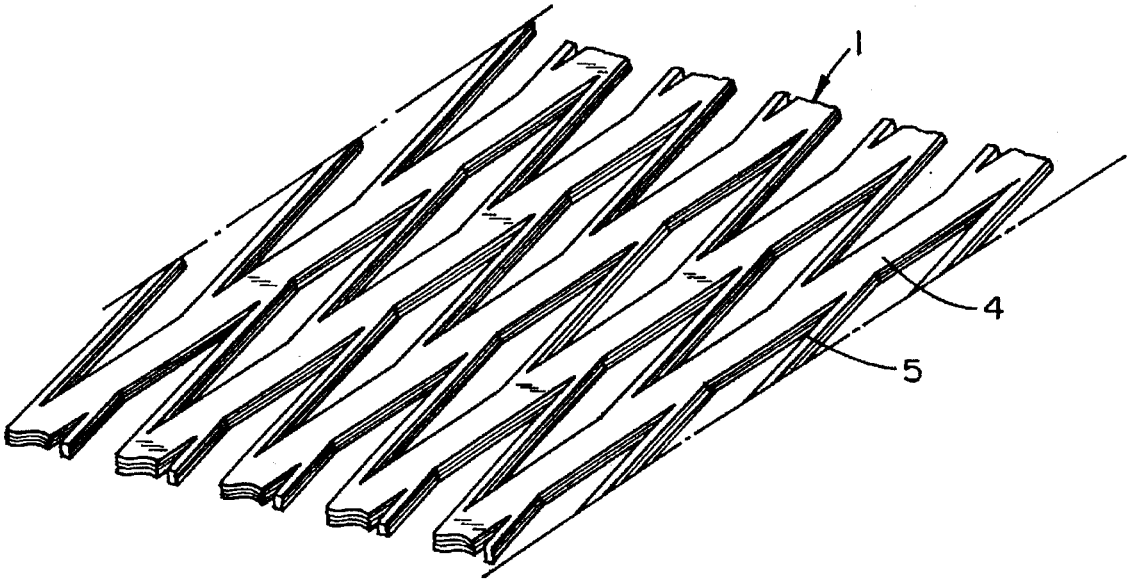
FIG. 1A is an enlarged perspective view of a part of a longitudinally monoaxially oriented reticular web (a) in one embodiment of the present invention.

The present invention will be described in more detail with reference to examples, but the scope of the present invention should not be limited to these examples.

Examples of polypropylene resins for use in a polypropylene resin layer (I) of the present invention include polypropylene homopolymers, and random copolymers and block copolymers of propylene as a main component and other α-olefins. Examples of the α-olefins include ethylene, 1-butene, 4-methylpentene-1 and 1-hexene. The content of the comonomer is selected within the range of 3 to 30 mol %. Furthermore, the MFR (melt flow rate) of the polypropylene resin is selected within the range of 0.01 to 50 g/10 minutes, preferably 0.1 to 30 g/10 minutes, more preferably 0.2 to 20 g/10 minutes.

As polypropylene resins for use in an adhesive layer (II) of the present invention, the polypropylene resins of the same kind as those for the above-mentioned polypropylene resin layer (I) and polypropylene resins of different kind can be used, but it should be noted that the melting point of polypropylene resin is lower than that of the polypropylene resin layer (I). Examples of the preferable polypropylene resin for the adhesive layer (II) include random copolymers and block copolymers of propylene and α-olefins, and above all, random copolymers of propylene and α-olefins such as ethylene and 1-butene are preferable.

Examples of polyethylene resins for use in the adhesive layer (II) of the present invention include polyethylene homopolymers having a density of 0.87 to 0.97 g/cm$^3$, and random copolymers and block copolymers of ethylene as a main component and other α-olefins having 3 to 12 carbon atoms. Typical examples of the α-olefins include propylene, 1-butene, 4-methylpentene-1 and 1-hexene. The content of the comonomer is selected within the range of 3 to 30 mol %. Other examples of polyethylene resins include copolymers of ethylene and monomers having a polar group such as ethylene-vinyl acetate copolymers, ethylene-acrylic or methacrylic acid copolymers and ethylene-acrylate or methacrylate copolymers.

The MFR of the ethylene resin is selected within the range of 0.01 to 50 g/10 minutes, preferably 0.1 to 30 g/10 minutes, more preferably 0.2 to 20 g/10 minutes. Above all, high-density polyethylene and ethylene-α-olefin copolymers having a density of 0.94 to 0.97 g/cm$^3$ are preferable to maintain fibrillating property, heat resistance and the like.

The ratio of thicknesses between the polypropylene layer (I) and the adhesive layer (II) of the above-mentioned multi-layer film is not especially limited, but in general, it is preferable for the mechanical strength and other properties that the thickness ratio of the adhesive layer is 50% or less, preferably 40% or less to the total thickness of the multi-layer film.

Furthermore, if the thickness of the adhesive layer (II) of the multi-layer film or the tape after orientation is at least 3 μm, various physical properties such as adhesive strength at the time of thermal adhesion can be satisfactory, but in general, the thickness of the adhesive layer (II) is selected within the range of 3 to 60 μm, preferably 5 to 50 μm.

It is preferable in view of the manufacturing process that the temperature difference between the melting point of the adhesive layer (II) and that of the polypropylene layer (I) is at least 5° C., preferably 10° to 50° C. or more.

With regard to the blending ratio of the mixture of the polypropylene resin and the polyethylene resin which are used to form the adhesive layer (II) of the present invention, the content of polypropylene resin is in the range of 95 to 70% by weight, preferably 90 to 75% by weight, more preferably 90 to 80% by weight, and the polyethylene resin content is in the range of 5 to 30% by weight, preferably 10 to 25% by weight, and more preferably 10 to 20% by weight.

If the blending ratio of the polyethylene resin is less than 5% by weight or more than 30% by weight, it is difficult to obtain a non-woven fabric having good heat resistance and high adhesive strength which are aimed in the present invention. In addition, the bubble is unsteady and the thickness is uneven in the film fabricating step, the tearing of film occurs in the orientation step, and the formation of unsplit portions and over-slit portions or spreading of slits occur in the slitting step.

In order to obtain a colored non-woven fabric or a weather resistant non-woven fabric successfully, it is necessary to add additives to the polypropylene layer (I) as an inner layer.

When the additives are added to the inner polypropylene layer (I), the soiling of a die lip is markedly reduced in the film fabrication, so that the frequency of the cleaning of the die lip can be decreased. In addition, in the fibrillation step, because the accumulation of additive powder, resin and scum can be decreased, the removal operation can be reduced. Particularly, in the prior art, when foreign matters are much accumulated, the blades of a fibrillator are clogged with them and the fibrillation cannot be carried out smoothly, so that the longitudinal excess splitting of a stretched film and the irregular splits occur in the fibrillating step with a result that a clear and regular network cannot be formed. Moreover, in the non-woven fabric which is contaminated with such foreign matters and which has such irregular network structure, not only the value of product is lowered but also the strength is lowered. However, according to the present invention, the additives are blended into the polypropylene layer (I), and hence the above-mentioned problems can be eliminated.

Examples of the additives which can be used in the present invention include weatherproofing agents, ultraviolet ray absorbers, dye stuffs or pigments, and inorganic fillers.

Examples of the above-mentioned ultraviolet ray absorbers or light stabilizers include benzotriazole, benzophenone derivatives, substituted acrylonitriles, salicylic acid derivatives, nickel complexes and hindered amines. The above-mentioned benzotriazole-based ultraviolet ray absorbers are exemplified by 2-(2'-hydroxy-5-methylphenyl)benzotriazole, 2-(2'-hydroxy-5,5'-tert-butylphenyl)benzotriazole and alkylated hydroxybenzotriazole.

Examples of the above-mentioned benzophenone-based ultraviolet ray absorbers include 2-hydroxy-4-methoxybenzophenone, 2,4-dihydroxybenzophenone, 2-hydroxy-4-octoxybenzophenone and 4-dodecyloxy-2-hydroxybenzophenone.

Examples of the above-mentioned acrylonitrile-based ultraviolet ray absorbers include 2-ethylhexyl-2-cyano-3,3'-diphenyl acrylate and ethyl-2-cyano-3,3'-diphenyl acrylate.

Examples of the above-mentioned salicylic acid-based ultraviolet ray absorbers include phenyl salicylate, p-tert-butylphenyl salicylate and p-octylphenyl salicylate.

Examples of the above-mentioned nickel complex-based ultraviolet ray absorbers include nickel-bis-octylphenyl sulfide and [2,2'-thio-bis(4-tert-octyl phenolate)]-n-butylamine nickel.

An example of the above-mentioned hindered amine-based light stabilizer is bis(2,2,6,6-tetramethyl-4-piperidyl) sebacate.

Among these light stabilizers, the hindered amine-based agent is most preferable.

The use quantity of these light stabilizers depends upon the uses, circumstances and purpose of the woven or non-woven fabric. It is necessary that its effective amount should be contained. In general, the amount of the light stabilizer is 300 ppm or more and preferably within the range of 300 to 10,000 ppm based on the polypropylene of the internal layer.

If the amount of the light stabilizer is less than 300 ppm, the duration of light resistance is short or its light resisting effect cannot be produced.

If its quantity is more than 10,000 ppm, even though the life of the light resisting effect is long, however, the cost increases undesirably.

Examples of the colorant and the pigment which can be used in the present invention include organic pigments and inorganic pigments. Examples of the organic pigments include azo compounds, anthraquinone compounds, phthalocyanine compounds, quinacridone compounds, isoindolinone compounds, dioxane compounds, perylene compounds, quinophthalone compounds and perinone compounds. Typical examples of the usable organic pigments include Food Yellow 4 (Tartrazine), Food Yellow 5 (Sunset Yellow FCF), Food Green 3 (Fast Green FCF), copper chlorophyll and sodium iron chlorophyllin which are registered in an official book of food additives. Besides them, the pigments which can be used for the coloring of synthetic resins are Phthalocyanine Blue, Phthalocyanine Green, Fast Yellow and Diazo Yellow.

Furthermore, examples of the inorganic pigment include white pigments such as titanium dioxide, white lead, zinc white, lithopone, baryta, precipitated barium sulfate, calcium carbonate, gypsum and precipitated silica; and cadmium sulfide, cadmium selenide, ultramarine blue, iron oxide, chromic oxide and carbon black.

As the antioxidant which can be used in the present invention, common antioxidants can be used. Especially, phenolic antioxidants and phosphorous antioxidants are particularly suitable.

Examples of the phenolic antioxidants include hindered phenolic compounds such as 2,2'-methylenebis(4-methyl-6-tert-butylphenol), 4,4'-butylidenebis(3-methyl-6-tert-butylphenol), 4,4'-thiobis(3-methyl-6-tert-butylphenol), tetrakis[methylene 3-(4'-hydroxy-3',5'-di-tert-butylphenyl) propionate]methane, n-octadecyl 3-(4'-hydroxy-3',5'-di-tert-butylphenyl)propionate, 2,4-bisoctylthio-6-(4'-hydroxy-3',5'-di-tert-butylanilino)-1,3,5-triazine, 1,3,5-tris(4'-hydroxy-3',5'-d-tert-butylbenzyl)-1,3,5-triazine-2,4,6(1H, 3H, 5H)-trione, 1,3,5-tris(3'-hydroxy-2',6'-dimethyl-4'-tert-butylbenzyl)-1,3,5-triazine-2,4,6(1H,3H,5H)-trione and 1,3,5-trimethyl-2,4,6-tris(4'-hydroxy-3',5'-di-tert-butylbenzyl) benzene.

Examples of the phosphorous antioxidants include compounds such as phosphites, phosphonites and phosphaphenanthrenes, and their typical examples include dioctadecylpentaerythrityl diphosphite, trioctadecyl phosphite, tris(nonylphenyl)phosphite, tris(2,4-di-tert-butylphenyl)phosphite, 9,10-dihydro-9-oxa-10-phosphaphenanthrene-10-oxide, tetrakis(2,4-di-tert-butylphenyl)-4,4'-biphenylene phosphonite.

Examples of the sulfur-containing antioxidants include thiols and sulfides, and their typical examples include 3,3'-thiodipropionic acid, dodecyl 3,3'-thiopropionate, dioctadecyl 3,3'-thiopropionate, pentaerythrityl tetrakis(3-dodecyl thiopropionate) and pentaerythrityl tetrakis(3-octadecyl thiopropionate).

The amount of the above-mentioned antioxidant to be used can be selected within the range of 0.02 to 1.0 part by weight, preferably 0.03 to 0.5 part by weight with respect to 100 parts by weight of the resin. If the amount of the antioxidant is less than 0.02 part by weight, any effect of anti-oxidant cannot be exerted, and even if it is more than 1.0 part by weight, any additional effect cannot be produced.

The antioxidants or the ultra-violet ray absorbers mentioned above can be used singly or in a combination of two or more.

It is preferable to use a combination of the phenolic antioxidant and the phosphorous antioxidant, because the effect can be markedly improved.

In particular, such a combination of the phenolic antioxidant and the phosphorous antioxidant can prevent the color change and discoloration by the thermal deterioration in the extrusion step and the light deterioration with the passage of time by ultraviolet ray. Therefore, it is desirable that these antioxidants are blended with the pigment or the like at an earlier stage of the production.

In the present invention, other additives such as sunproofing agents and dispersants can be used. It is desirable to use these additives because they can avoid effectively the function of accelerating the light deterioration in the surface layer of the woven or non-woven fabric by the sunproofing agent or the combination of the sunproofing agent and the phenolic antioxidant, phosphorous antioxidant or sulfur-containing antioxidant. In addition, these additives leads to the synergistic effect in the weather resistance.

A typical example of the sunproofing agent is aluminum powder.

The film containing the above-mentioned aluminum powder can reflect light rays and it is effective for the protection and growing of agricultural crops. However, it is generally known that such a film has a function to accelerate the light deterioration of the resin. In the present invention, however, the use of this sunproofing agent can produce further large effect.

The woven or non-woven fabric of the present invention will be described in detail with reference to the attached drawings.

Figure 1B:
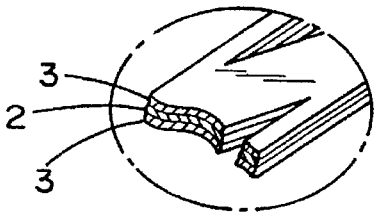
FIG. 1B is a cross-section view of the reticular web (a) of FIG. 1A illustrating polypropylene and adhesive layers.

FIG. 1A is an enlarged perspective view of a longitudinally monoaxially oriented reticular web (a) as an embodiment of the present invention. It is prepared by monoaxially orienting a multi-layer film in the longitudinal direction of the film, then subjecting it to fibrillation, and spreading transversely. FIG. 1B shows that a longitudinally monoaxially oriented reticular web (1) consists of stem fibers (4) and branch fibers (5). These fibers are composed of a polypropylene layer (2) which is monoaxially oriented in the longitudinal direction and adhesive layers (3, 3) composed of a mixture of polypropylene and high-density polyethylene which are laminated on both surfaces of the layer (2).

Figure 2B:
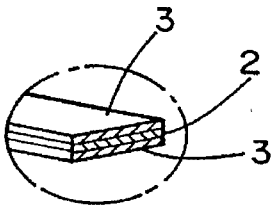
FIG. 2B is a cross-sectional view of the reticular web (b) of FIG. 2A illustrating polypropylene and adhesive layers.
Figure 2A:
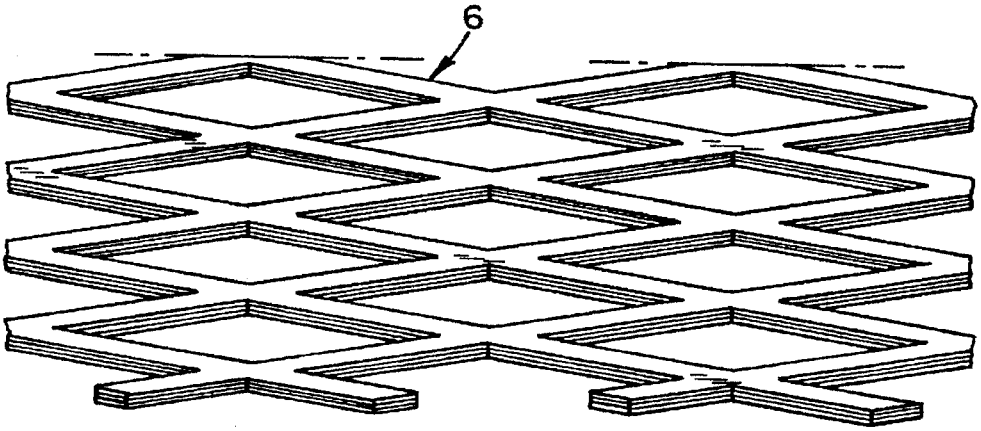
FIG. 2A is an enlarged perspective view of a part of a transversally monoaxially oriented reticular web (b) of another embodiment of the present invention.

FIG. 2A is an enlarged perspective view of a transversely monoaxially oriented reticular web (b) of an embodiment of the present invention. It is prepared by transversely slitting and orienting a multi-layer film, and then spreading in the direction of its length. FIG. 2B demonstrates that the transversely monoaxially oriented reticular web (6) comprises a polypropylene layer (2) which is monoaxially oriented at right angles (in the transverse direction) to the longitudinal direction of the film and adhesive layers (3, 3) which comprise a mixture of polypropylene and high-density polyethylene and laminated on both surfaces of the layer (2).

Figure 3:
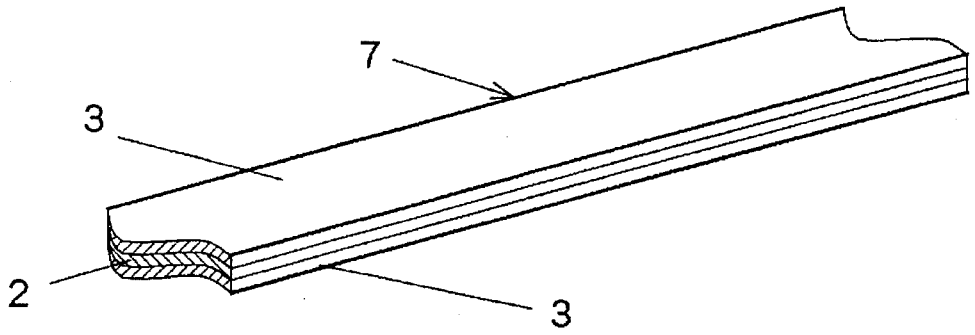
FIG. 3 is an enlarged perspective view of a monoaxially oriented multi-layer tape (c) of an embodiment of the present invention.

FIG. 3 is an enlarged perspective view of an embodiment of a monoaxially oriented multi-layer tape (c). In this drawing, a monoaxially oriented multi-layer tape (7) comprises a polypropylene layer (2) which is monoaxially oriented as in the above-mentioned reticular web and adhesive layers (3, 3) comprising the mixture of polypropylene and high-density polyethylene and laminated on both surfaces of the layer (2).

The above-mentioned monoaxially oriented multi-layer tape (c) can be obtained by monoaxially orienting a multi-layer film having at least two layers prepared by a multi-layer extrusion such as blown film extrusion and multi-layer T-die film method, at a stretching ratio of 1.1 to 15, preferably 3 to 10 in a longitudinal and/or a transversal direction before and/or after the slitting.

The woven or non-woven fabric of the present invention is those prepared by laminating or weaving crosswise at least one kind of the above monoaxially oriented materials so that the axes orientation of the materials may intersect with each other with interposing the adhesive layer (II).

Figure 4:
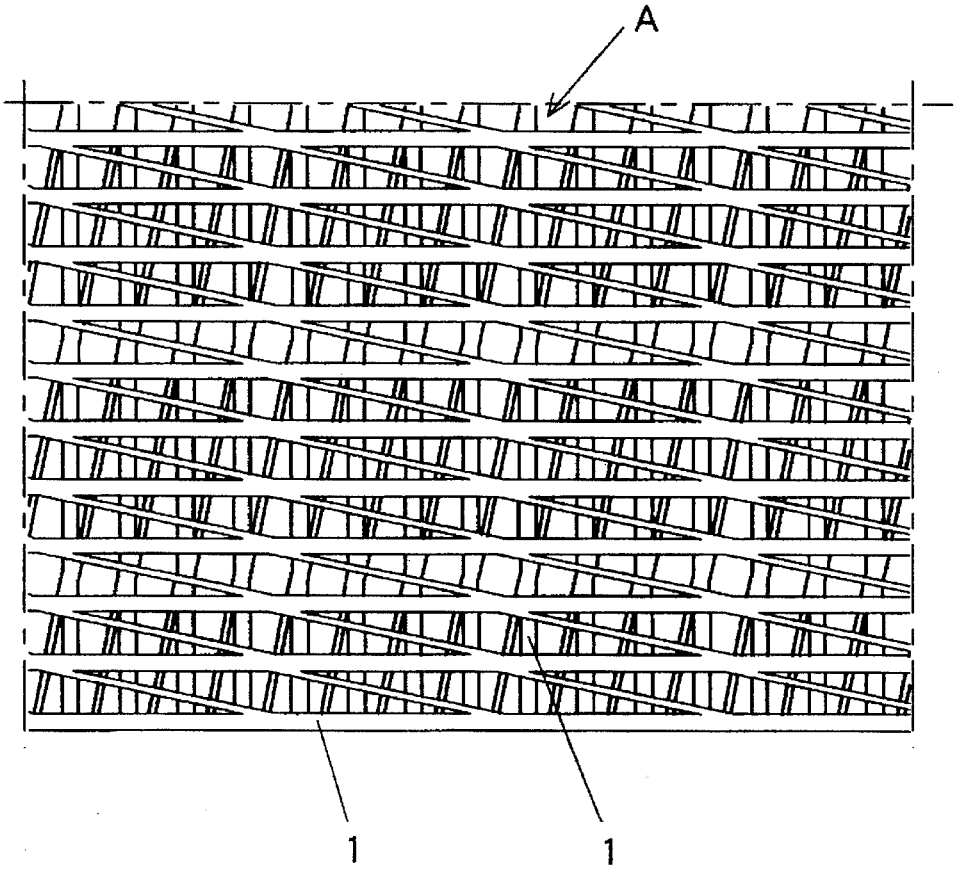
FIG. 4 is an enlarged plan view of a non-woven fabric (A) obtained by laminating the monoaxially oriented multi-layer webs (a) together (layer structure: a/a) of an embodiment of the present invention.
Figure 5:
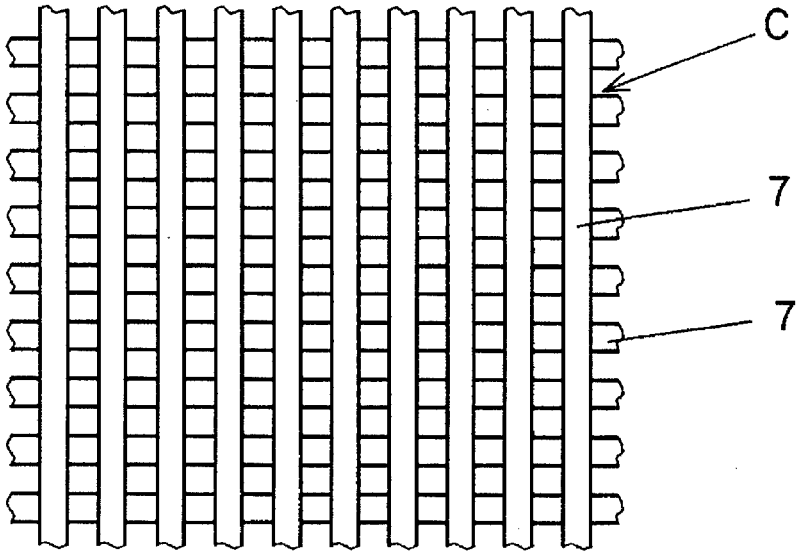
FIG. 5 is a plan view of a non-woven fabric (C) obtained by laminating the monoaxially oriented multi-layer tapes (c) together (layer structure: c/c) of an embodiment of the present invention.
Figure 6:
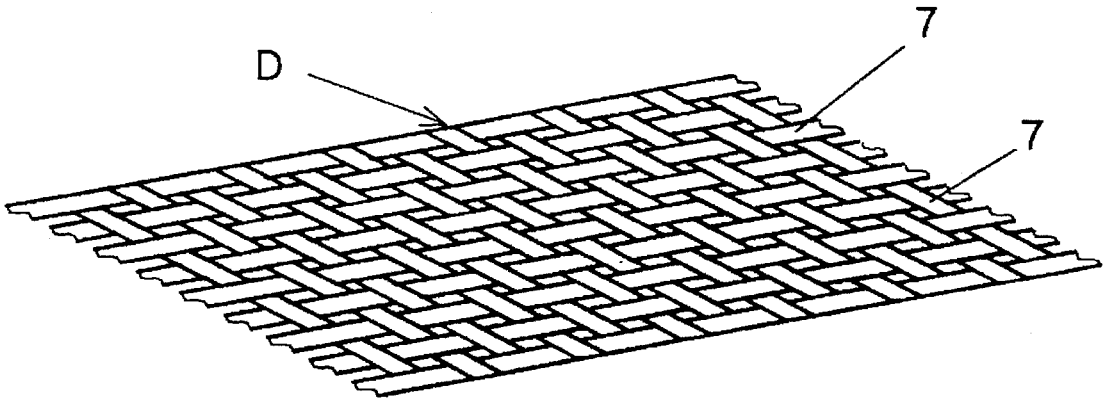
FIG. 6 is a perspective view of a woven fabric (D) obtained by weaving the monoaxially oriented multi-layer tapes (c) of an embodiment of the present invention.

Examples of typical combinations of monoaxially oriented materials are:

(1) A non-woven fabric (A) prepared by laminating (layer structure: a/a) longitudinally monoaxially oriented reticular webs 1 which are obtained by fibrillating longitudinally monoaxially oriented multi-layer films (a), as shown in FIG. 4, (2) a non-woven fabric (B) prepared by laminating (a/b) a monoaxially oriented reticular web (a) obtained by fibrillating a longitudinally monoaxially oriented multi-layer film and a transversely monoaxially oriented reticular web (b) obtained by transversely fibrillating a transversely oriented multi-layer film, (3) a non-woven fabric (C) prepared by laminating (c/c) monoaxially oriented multi-layer tapes (c) as shown in FIG. 5, (4) a woven fabric (D) prepared by weaving monoaxially oriented multi-layer tapes (c) as shown in FIG. 6, (5) a non-woven fabric of the layer structure of (A/B), (A/C) or (A/D), (6) a non-woven fabric of (B/C) or (B/D), (7) a non-woven fabric of (C/D), (8) a non-woven fabric of (a/C), (a/D), (b/C/b) or (b/D/b), (9) a non-woven fabric of (C/a/C), (C/b/C), (D/a/D) or (D/b/D),

(10) a non-woven fabric of (A/C/A), (A/D/A), (B/C/B) or (B/D/B), and

(11) a woven or non-woven fabric comprising a non-woven fabric or the like of (A/C/B) or (A/D/B).

In the following, the method for preparing the non-woven fabric of the present invention is described with reference to the attached drawings.

Figure 7:
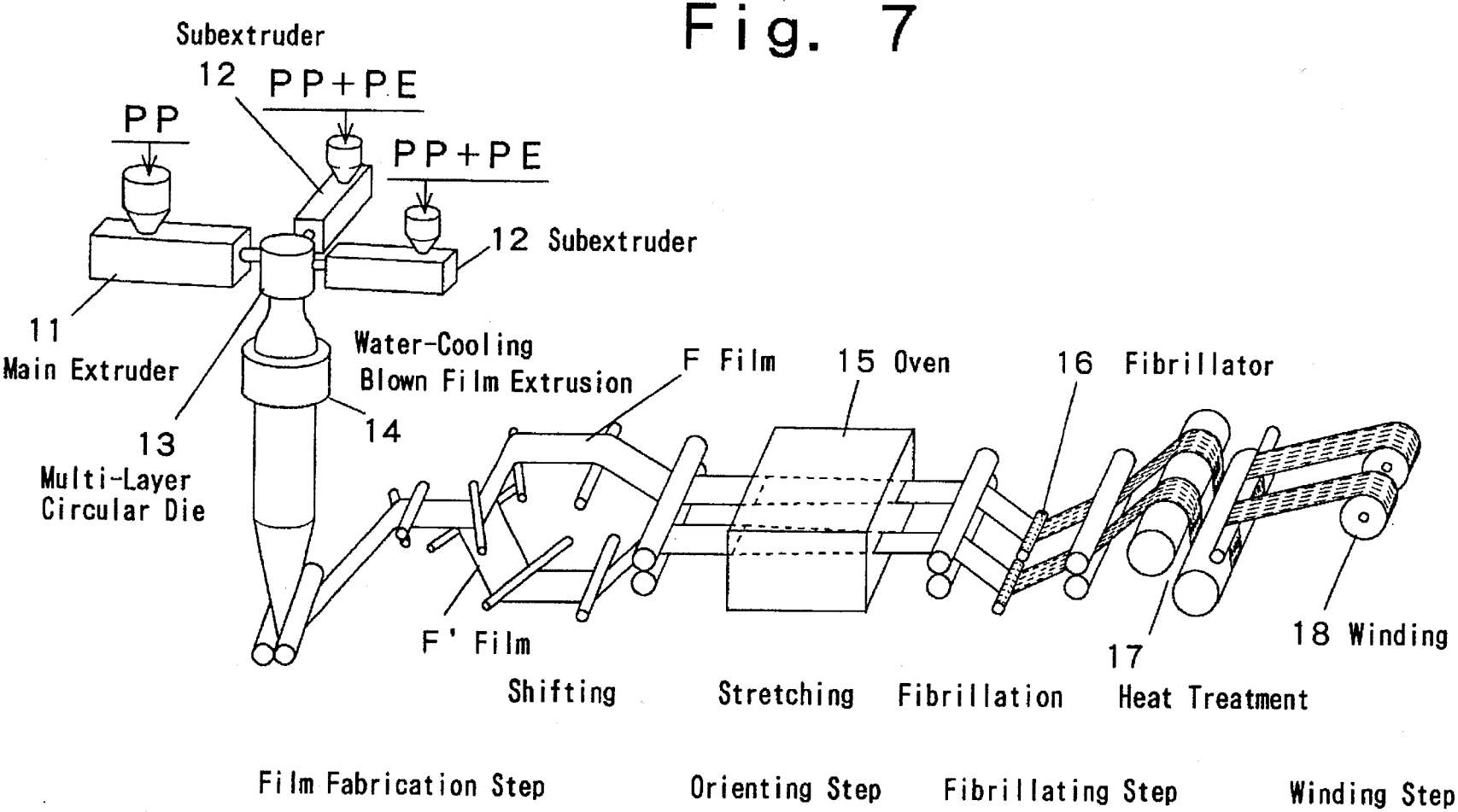
FIG. 7 is a schematic illustration of a manufacturing process for the longitudinally monoaxially oriented reticular web (longitudinal web a) of the present invention.

FIG. 7 is a schematic illustration of a manufacturing process of the longitudinally monoaxially oriented reticular web (a) as an embodiment of the present invention.

In FIG. 7, a longitudinally monoaxially oriented reticular web (a) is prepared through:

(1) a film fabricating step for preparing a multi-layer film, (2) an orientation step for orienting the multi-layer film, (3) a fibrillating step for fibrillating the oriented multi-layer film in a direction parallel to the orientation axis, and (4) a winding step for winding the fibrillated film.

The each of the above steps will be described.

In the film fabricating step for producing the multi-layer film of the present invention in FIG. 7, polypropylene resin is fed to a main extruder (11) and a mixture of polypropylene resin and polyethylene resin is fed to two subextruders (12, 12), respectively. After that, a multi-layer film is formed, which film comprises a core layer (an oriented layer) obtained from the polypropylene resin by the blown film extrusion method of the main extruder (11), and an inner layer and an outer layer made of the mixture of polypropylene resin and polyethylene resin fed from the two subextruders (12, 12). In the present44 invention, the film is fabricated through a multi-layer circular die (13) using the three extruders and water-cooling down-blow extrusion process (14). However, the method for preparing the multi-layer film is not limited to the multi-layer blown film extrusion method or the multi-layer T-die method. Above all, the water-cooling blown film extrusion method is preferable because it has a feature that a thick film can be cooled rapidly without losing the transparency of the film.

In the orientation step of the present invention, the tubular multi-layer film prepared in the above step is cut into two sheets films (F, F'), and these films are then oriented at an orientation ratio of 1.1 to 15, preferably 5 to 12, more preferably 6 to 10, relative to the initial size. In the orientation step, the two sheets of films are heated to a predetermined temperature by an oven (15) equipped with an infrared heater or a hot-air fan.

The above-mentioned orientation temperature is lower than the melting point of the polypropylene resin of the core layer, and it is usually in the range of 20° to 160° C., preferably 60° to 150° C., and more preferably 90° to 140° C. The orientation is preferably carried out step by step in a multi-stage apparatus.

For carrying out the orientation, there are a roll orientation method, a hot plate orientation method, cylinder orientation method and hot air orientation method. The orientation method as referred to in the present invention includes these ordinary orientation method as well as the rolling method. Any one of the above-mentioned orientation methods can be used but a free monoaxial stretching method is particularly preferable.

The rolling method referred to in the present invention is a method in which a thermoplastic resin film is passed between a set of two hot rolls having a gap between them smaller than the thickness of the film, and the film is pressed through the gap at a temperature lower than the melting point (softening point) of the resin film, thereby stretching the film as much as the ratio of the decrease in thickness.

Furthermore, the free monoaxial stretching method as herein referred to means a method in which the stretching distance (the distance between a low-speed roll and a high-speed roll) is made sufficiently large in comparison with the width of the film, and the film is stretched freely with allowing the decrease of the width of stretched film.

In the fibrillating step of the present invention, the multi-layer film which was oriented in the above step is brought into sliding contact with a fibrillator (rotary blades) (16) which is rotated at a high speed, to fibrillate the film.

As the above-mentioned fibrillating method, there can be used any one of methods to make numerous cuts or slits in the monoaxially oriented multi-layer film such as mechanical methods to beat, twist, scrape, rub, or brush the film material and other methods using air jet, ultrasonic wave or laser beams.

Among these fibrillating methods, the rotary mechanical method is preferable. In the rotary mechanical method, fibrillators of various types such as a tapping screw type fibrillator, a file-like coarse surface fibrillator, and a needle roll fibrillator can be used. For example, the preferable tapping screw type fibrillator usually has a pentagonal or a hexagonal shape and 10 to 40 threads, preferably 15 to 35 threads per inch, and the preferable file-like coarse surface fibrillator is disclosed in Japanese Utility Model Publication No. 51-38980 (1976). The file-like coarse surface fibrillator is a rod whose cross-section is circular and has a surface like a round file for iron works or a similar ones. On the surface of the rod, two spiral grooves are formed at regular a pitch. Typical examples of such file-like coarse surface fibrillator are described in U.S. Pat. Nos. 3,662,935 and 3,693,851.

The method for preparing the above-mentioned reticular web is not limited particularly. However, a preferable method comprises arranging a fibrillator between nipping rolls, moving the monoaxially oriented multi-layer film along the fibrillator under the application of tension, and bringing the multi-layer film into sliding contact with the fibrillator which is rotated at a high speed, to fibrillate the film, thereby making a reticular film.

The moving velocity of the film is usually in the range of 1 to 1000 m/min, preferably 10 to 500 m/min. Furthermore, the rotational speed (peripheral velocity) of the fibrillator can be suitably selected in consideration of the physical properties of the film, the moving velocity of the film, arid the state of the desired reticular film, but it is usually in the range of 10 to 3000 m/min, preferably 50 to 1000 m/min.

The longitudinally monoaxially oriented reticular web (a) which has been thus fibrillated is, if desired, spread in the direction of its width, subjected to a heat treatment step (17), wound up to a predetermined length in the winding step (18), and the obtained roll is supplied as a raw fabric for the non-woven fabric.

The method for preparing the non-woven fabric in the second aspect of the present invention is concerned with the method in which two longitudinally monoaxially oriented reticular webs (a) are laminated together. The fundamental procedure of this method comprises continuously feeding one longitudinally monoaxially oriented reticular web (a) and another longitudinally monoaxially oriented reticular web (a') is put in layers from the direction in a right angle, in which the latter web (a') is so cut as to have a length equal to the spread width of the former web (a) and then, thermally bonding the two sheets of webs together.

Figure 8:
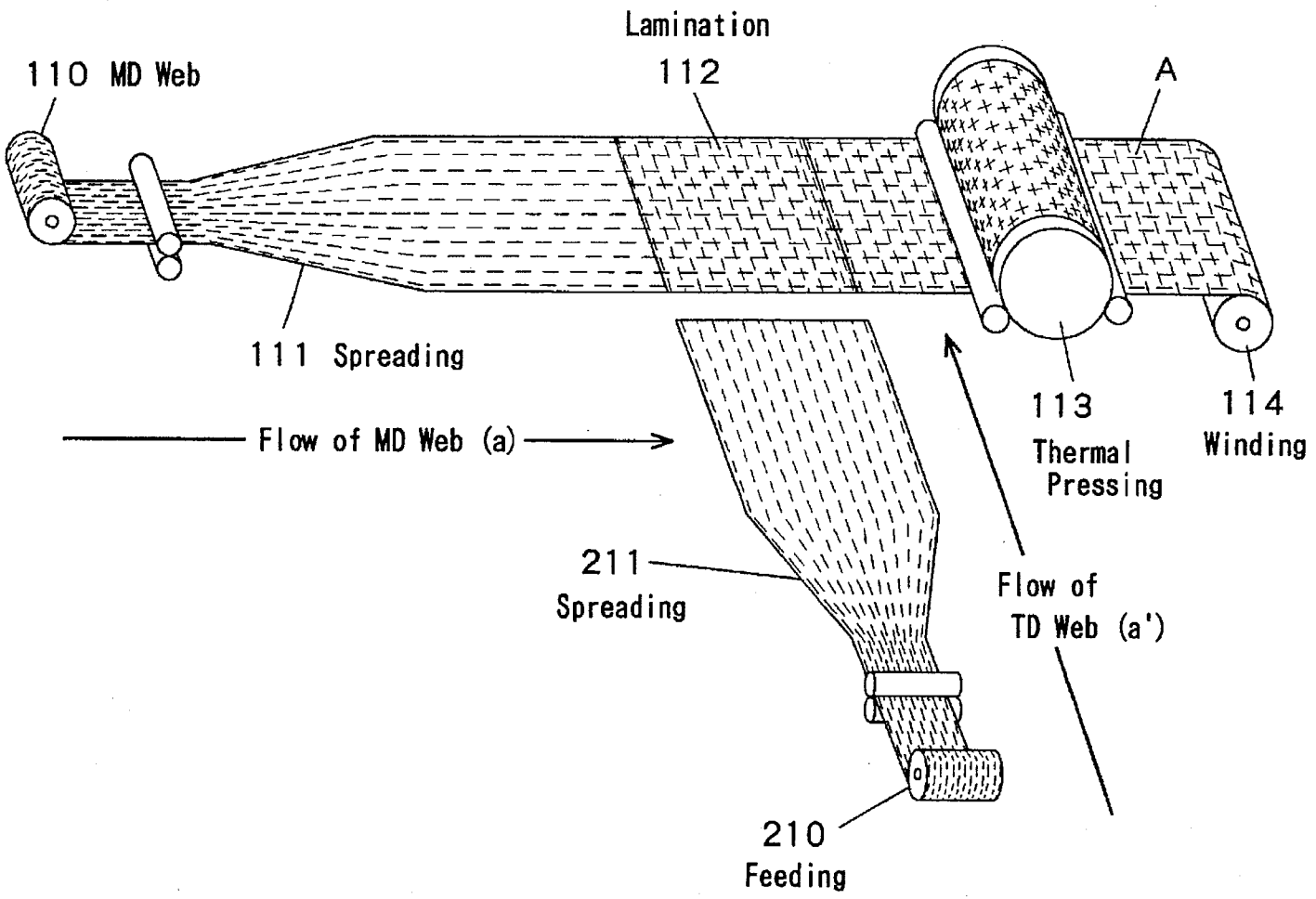
FIG. 8 is a schematic illustration of a manufacturing process for the non-woven fabric (A) obtained by laminating (a/a) the longitudinally monoaxially oriented reticular webs (a) of the present invention.

FIG. 8 is a schematic illustration of the manufacturing process of the non-woven fabric (A) obtained by laminating (a/a') of the longitudinally monoaxially oriented reticular webs (a and a') in the second aspect of the present invention.

In FIG. 8, the longitudinally monoaxially oriented reticular web (a) (hereinafter referred to as "MD web" and denoted with "110" in the drawing) is set to a raw fabric feeding roll and it is fed at a predetermined feed velocity to a width spreading (tentering) step (111), in which the width of the MD web is spread several times by a width spreading machine (not shown, cf: Japanese Utility Model Publication No. 4-35154 (1992)). If necessary, the spread MD web is subjected to heat treatment. The other longitudinally monoaxially oriented reticular web (a') (hereinafter referred to as "TD web") (210) is set to a raw fabric feeding roll and it is fed at a predetermined feed velocity to a width spreading step (211), in which the width of the transversal web is spread several times by a width spreading machine, which is the same as that used for the MD web. If necessary, the spread transversal web is also subjected to heat treatment. After that, the transversal web is cut to a length equal to the width of the MD web (110), and then it is fed on or beneath the MD web (110) at right angles to the running film of the MD web, and at this time, the TD web is laminated together with the MD web in a lamination step (112) so that the orientation axes of these webs may intersect with each other at right angles. The laminated webs are then passed to a thermally pressing step (113), in which the laminated webs are thermally bonded together at a temperature lower than the melting point of the polypropylene layer (I), i.e., the oriented core layer and which is higher than the melting point of the adhesive layer (II). The thus bonded laminate of webs is wound up in a winding step (114) to obtain a product (crosswise laminated non-woven fabric).

The fundamental method for preparing the non-woven fabric in the third aspect of the invention comprises continuously feeding a transverally monoaxially oriented reticular web (TD web, b) and the longitudinally monoaxially oriented reticular web (MD web, a), and they are laminated and thermally bonded together. More particularly, the method for preparing the polypropylene non-woven fabric comprises the steps of fabricating a multi-layer film comprising a polypropylene resin layer (I) obtained by extrusion and an adhesive layer (II) of a mixture of a polypropylene resin and a polyethylene resin laminated on one surface or both surfaces of the polypropylene resin layer (I), slitting the multi-layer film (after slightly orienting the multi-layer film, if desired) at right angles to the longitudinal direction of the multi-layer film, laminating the obtained TD web (b) obtained by transversely orienting the slit film on the MD web (a) with interposing the adhesive layer (II), and then thermally bonding these webs, while the width of the MD web (a) is spread.

Figure 9:
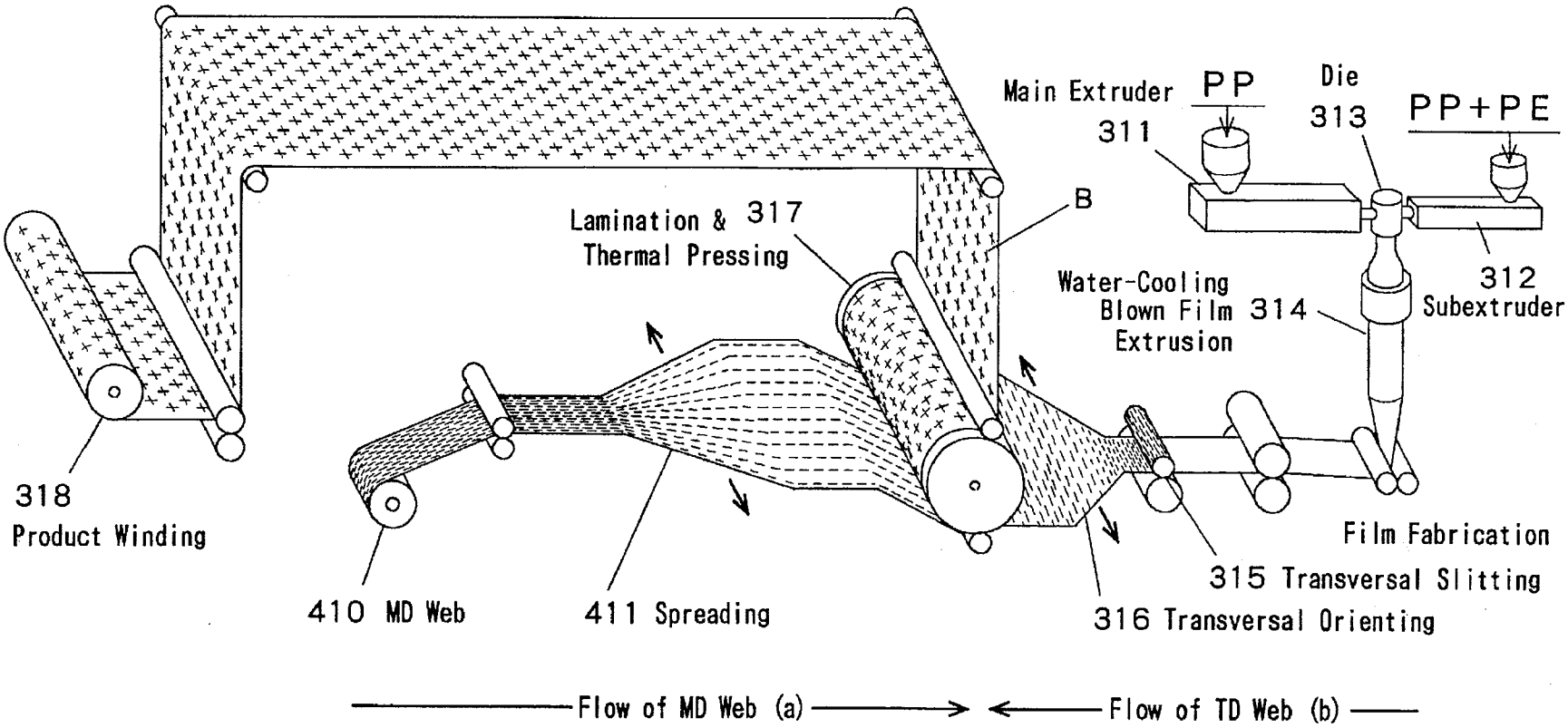
FIG. 9 is a schematic illustration of a manufacturing process for the non-woven fabric (B) obtained by laminating (a/b) the longitudinally monoaxially oriented reticular web (a) and the transversally monoaxially oriented reticular web (b) of the present invention.

FIG. 9 is a schematic illustration of a manufacturing process of the non-woven fabric (B) obtained by laminating (a/b) the MD web (a) and the TD web (b) in the third aspect of the present invention. This manufacturing process has the following steps:

(1) a film fabricating step for preparing a multi-layer film, (2) a slitting step for slitting the multi-layer film at right angles to the longitudinal direction of the multi-layer film, (3) an orienting step for transversely orienting the multi-layer film, and (4) a pressing step for laminating the MD web on the TD web and thermally pressing them.

The respective steps will be described.

In FIG. 9, in the film fabricating step for preparing the multi-layer film, polypropylene resin is fed to a main extruder (311) and a mixture of polypropylene resin and polyethylene resin is fed to a subextruder (312), and the blown film extrusion is then carried out to form two layers of films by flattening a tubular film. This tubular film is composed of an inner layer of the polypropylene resin fed from the main extruder (311) and an outer layer of the mixture of polypropylene resin and polyethylene resin fed from subextruder (312). In the present invention, the film can be formed through a multi-layer circular die (313) with the use of the two extruders and a down-blow water-cooling blown film extrusion apparatus (314). The method for preparing the multi-layer film is not particularly limited to the multi-layer blown film extrusion method or a multi-layer T-die film method as stated in the above second aspect of the present invention. Among these molding methods, the water-cooling blown film extrusion method is preferable, which method has a feature that thick films can be rapidly cooled to maintain the transparency of the obtained film. Furthermore, according to the present invention, if necessary, the obtained film is slightly oriented by pressing it between rolls, to bond the inner polypropylene layers of the flattened tube, thereby obtaining a pressed film having a three-layer structure of adhesive layer (II)/polypropylene layer (I)/adhesive layer (II). In this method, the two extruders can be used in contrast to the second aspect of the present invention in which the three extruders are used, which leads to a large economical advantages.

The slitting step of the present invention comprises pinching the tubular multi-layer film to be flattened, rolling the film to slightly orient it, thereby obtaining the film having a three-layer structure, and then transversely slitting the film at right angles to its running direction to form cross-stitch-like transversal slits (315) in the film. The above-mentioned slits are formed by the use of sharp blades such as a heat cutter, razor blades or high-speed rotary cutting blades, a score cutter, a shear cutter or a heat cutter, but the heat cutter is most preferable.

Some examples of the heat cutter are disclosed in Japanese Patent Publication No. 61-11757 (1986), U.S. Pat. Nos.

4,489,630, 2,728,950 and so forth. The slitting by the heat cutter produces an effect that the edges of slits in the slightly oriented film by the rolling in the previous step are heaped up, and owing to this effect, it can be prevented that the slits are torn and spread in the orientation process in the subsequent transversely orientating step.

In the orientation step of the present invention, the slit film is transversely oriented in the section (316). The orientation can be carried out by a tenter method or a pulley method, but the pulley method is preferable because a small-sized device can be used economically in this method.

This pulley method is described in British Patent No. 849436 and Japanese Patent Publication No. 57-30368 (1982). The orientation temperature and other conditions are the same as those in the foregoing process for the MD web.

The TD web which is oriented transversely is then passed to a thermally pressing step (317).

Meanwhile, the MD web (410) prepared above is fed from a raw fabric feeding roll and fed at a predetermined feed velocity, and then it is transferred to a width spreading step (411), in which the width of the web is spread several times by the above-mentioned spreader. In the next step, the spread web is superposed upon the above-mentioned TD web, and then they are forwarded to the thermally pressing step (317), in which the MD web and the TD web are laminated together and thermally bonded so that the axes of orientation of these webs intersect with each other. After the checking of failures such as mesh skipping or else, the laminate is moved to a winding step (318), in which the laminate is wound up to obtain a crosswise laminated non-woven fabric as a product.

The fourth aspect of the present invention is concerned with a heat-resistant reinforced laminate which is obtained by laminating a base material (M) and at least one monoaxially oriented film (F) of the following (a), (b) and (c) comprising a polypropylene resin layer (I) and an adhesive layer (II) composed of a mixture of polypropylene resin and polyethylene resin which is laminated on one surface or both surfaces of the layer (I), or a polypropylene non-woven fabric (F1) or woven fabric (F2) obtained by crosswise laminating or weaving the monoaxially oriented films with interposing the adhesive layer (II) so that the oriented axes of the films may intersect with each other.

Monoaxially oriented films (a) a longitudinally monoaxially oriented reticular web, (b) a transversely monoaxially oriented reticular web, and (c) a monoaxially oriented multi-layer tape.

The base material which can be used in the fourth invention is at least one member selected from the group consisting of papers, films or sheets of synthetic resin, films or sheets of foamed material, rubber sheets, porous films, random non-woven fabrics, woven fabrics and metallic foils.

Examples of the papers include kraft papers, Japanese papers, glassine papers and cardboards. Printed matters of these papers can also be used.

Examples of the synthetic resin films and sheets include films and sheets made of polyolefins such as polyethylene and polypropylene, polystyrene, polyesters, polyamides, saponified ethylene-vinyl acetate copolymers, polyvinyl alcohol resins, polyvinyl chlorides, polyvinylidene chlorides, polycarbonates and acrylic resins. Among them, the polyolefin resins, especially, the films and sheets of polypropylene resin have been most widely used in view of economy, heat resistance, mechanical strength and other properties. No particular restriction is put on the use of these films and sheets, and they may be directly laminated with the woven or non-woven fabrics by the T-die film method or the like.

No particular restriction is put on the kind of foamed films and sheets, but their common examples include foamed films and sheets made of polyolefins such as polyethylene and polypropylene, and thermoplastic resins such as polystyrene, polyesters and polyamides. Among them, the films and sheets made of the polyolefin resins, especially, the polypropylene resins are preferable in view of economy, heat resistance, mechanical strength and so forth.

Examples of the rubber sheets include sheets made of ethylene-propylene copolymer rubber, ethylene-propylene-diene copolymer rubber, styrene-butadiene copolymers, acrylonitrile-styrene copolymer rubber, SIS (styrene-isoprene-styrene block copolymer), SBS (styrene-butadiene-styrene-block copolymer) and polyurethane, and no particular restriction is put on the use of the rubber sheets. For example, the rubber sheet may be directly laminated with the woven or non-woven fabric by the T-die method or the like.

Examples of the porous films include porous films made of polyolefins such as polyethylene and polypropylene, polystyrene, polyesters, polyamides, saponified ethylene-vinyl acetate copolymers, polyvinyl chloride, polyvinylidene chloride and polycarbonate. Among all, the porous films made of the polypropylene resin are most preferable in view of economy, heat resistance, mechanical strength and so forth. These porous films can be prepared by any suitable method such as a method of blending the above-mentioned resin with a filler or else, and then orienting it, or a method utilizing extraction with a solvent. No particular restriction is put on the usage of the porous films.

Examples of the random non-woven fabrics include the materials of interlocked multi-filaments and the material of staple fibers. More preferable one is a fibrous random non-woven fabric which is prepared by using high-melting point first fibers and low-melting second fibers.

Typical examples of the fibrous random non-woven fabric include (1) a random non-woven fabric obtained by interlocking a mixture of high-melting first fibers or their web and low-melting second fibers or their web or a thermally adhesive fibers, (2) a random non-woven fabric obtained by interlocking composite fibers comprising high-melting first fibers as a core material and low-melting second fibers as a sheath material, (3) a random non-woven fabric obtained by interlocking parallel type composite fibers comprising high-melting first fibers and low-melting second fibers, (4) a random non-woven fabric obtained by interlocking melt blow filaments, and (5) a random non-woven fabric obtained by sheet making using high-melting synthetic pulp and/or fiber or its web and low-melting synthetic pulp and/or fiber or its web.

Examples of the above high-melting first fibers include synthetic fibers such as high-density polyethylene, polypropylene, polyesters, polyamides and polyacrylates, and natural fibers such as cotton, wool and hemp. If necessary, mineral fibers such as rock wool, metallic fiber, glass fiber or whisker may be used together with the high-melting first fiber.

Typical examples of the above-mentioned core type and parallel type composite fibers include various combinations of high-density polyethylene (HDPE)/low-density polyethylene (LDPE), HDPE/ethylene-vinyl acetate copolymer (EVA), LDPE/polyvinyl alcohol resin (PVA), polypropylene (PP)/propylene-ethylene copolymer (PEC), PP/HD, PP/PVA, polyester (PEs)/copolymer polyester (CPEs), PEs/HDPE, PEs/PP, polyamide (PA)/PP and PA/HDPE, and examples of commercially available fibers such as NBF (trademark: made by Daiwa Spinning Co., Ltd.), ES Fiber (trademark: made by Chisso Corporation), UC Fiber (trademark: made by Ube Nitto Kasei Co., Ltd.), Elbes (trademark: Unitika Ltd.) and Sunmore (Sanwa Seishi Co., Ltd).

Examples of the melt blow non-woven fabric of the present invention include melt blow non-woven fabrics made of thermoplastic resins, for example, polyolefins such as polyethylene and polypropylene, polystyrene, polyesters, polyamides, saponified ethylene-vinyl acetate copolymers, polyvinyl chlorides, polyvinylidene chlorides and polycarbonates. Among them, the melt blow non-woven fabrics made of the polyolefin resins, especially, the polypropylene resins are preferable in view of economy, heat resistance, mechanical strength and so forth.

The above-mentioned woven-fabrics used as the base material include woven-fabrics of flat yarns and multi-filaments of synthetic resins as well as organic and inorganic fibers such as natural fibers, synthetic fibers, glass fibers and carbon fibers, and no particular restriction is put on the kind of woven-fabric.

The metallic foils which can be used in the present invention include foils of aluminum, iron, nickel, gold and silver. Above all, the aluminum foil is preferable in view of economy, mechanical strength and so forth.

Examples of the method for preparing the laminate of the present invention include an extrusion lamination method, a dry lamination method, and a method which comprises the steps of subjecting the above-mentioned base material and/or the woven or non-woven fabric to physical surface treatment such as corona discharge treatment, and then thermally bonding the same.

As another method, the monoaxially oriented sheet or the woven or non-woven fabric of the present invention may be used as the base material, in which the above-mentioned core type or parallel type composite fiber may be directly melt-blown on the base material to directly and integrally apply to the random woven or non-woven fabric as the base material.

In the polypropylene woven or non-woven fabric of the present invention, a mixture of polypropylene and polyethylene is used as an adhesive layer, whereby moldability in film fabrication, fibrillating property after orientation, heat resistance, tear resistance and adhesive strength can be much improved.

Furthermore, when additives such as a light-resisting agent and a colorant are added to the polypropylene layer (I) as the inner layer of the polypropylene woven or non-woven fabric, the soil of a die lip in the film fabrication, irregular fibrillating after the orientation and other troubles can be avoided, and products are hardly contaminated, so that the yield of the products can be outstandingly improved. Moreover, in the heat-resistant reinforced laminate comprising the woven or non-woven fabric and a base material, the adhesive strength, heat resistance, tear resistance and other properties can be improved.

The present invention will be described in more detail with reference to examples.

EXAMPLES 1 to 6

In a film fabricating step shown in FIG. 7, adhesive layers comprising each composition obtained by mixing propylene-ethylene random copolymer (trademark: Chisso Polypro FK841, made by Chisso Corporation) and high-density polyethylene (density=0.956 g/cm$^3$, MFR=1.0 g/10 min, trademark: Nisseki Staflene E710, made by Nippon Petrochemicals Co., Ltd.) in a blend ratio shown in Table 1 were laminated on both surfaces of a core layer comprising a polypropylene (density=0.90 to 0.91 g/cm$^3$, MFR=1.8 g/10 min, trademark: Nisseki Polypro E120G, made by Nippon Petrochemicals Co., Ltd.) by a multi-layer water cooling blown film extrusion method to form a multi-layer film of a three-layer structure having a thickness ratio of adhesive layer 25 μm/core layer 100 μm/adhesive layer 25 μm and a width of 1 m. Next, in an orientation step, while moving forward the multi-layer film, it was oriented 9 times at a predetermined temperature. After that, in the fibrillating step, the multi-layer film was treated with a rotary fibrillator which is described in Japanese Utility Model Publication No. 51-38979 (1976) to form numerous slits in the longitudinal direction in a cross-stitch pattern, thereby preparing a longitudinally monoaxially oriented reticular web having of 20,000 m in length.

In the next step of width spreading step, this longitudinally monoaxially oriented fibrillated web was spread 2.5 times in a transversal direction to obtain a reticular web (a). Then, in a lamination step, the reticular webs (a) are crosswise laminated so that the orientation axes of the webs intersect with each other, and they were thermally bonded at an adhesive temperature of 140° C. to prepare a non-woven web (A). For the thus prepared non-woven web (A), adhesive strength, tensile strength and elongation were measured, and the results are shown in Table 1. In addition, the evaluation results of the film fabricating properties and fibrillating properties of the oriented multi-layer film are also shown in Table 1.

The evaluation was carried out as follows.

(1) Film fabricating property

OO: Very good, bubbles were quite stable (negative pressure=30 mm Aq or more)

O: Good, bubbles were stable (negative pressure=20 to 30 mm Aq)

x: Not good, bubbles were unstable and largely swung (negative pressure=5 to 20 mm Aq)

(2) Fibrillating property

OO: Number of small splits or skips: 0 to 1/5000 m

O: Number of small splits or skips: 2 to 3/5000 m

Δ: Number of small splits or skips: 2 to 3/500 m x: Numerous small splits or skips were present all over the film and large splits were also present (3) Tensile strength and elongation A low-speed stretch-type tensile testing machine (Shopper type) was used. A space between an upper grip and a lower grip of the testing machine was set to 100 mm, and both edges of a test piece (length=200 mm, width=150 mm) were fixed. The test piece was then pulled at a tensile velocity of 200 mm/min, and the load (kg/5 cm) and the elongation (%) at which the test piece was severed were measured.

(4) Adhesive strength

A Tensilone (trademark: made by Toyo Sokki Co., Ltd.) was used, and the portion between the top and the center of a test piece (length=200 mm, width=50 mm) was hooked on a U-shaped tool connected to a load cell of the tensilone, and the bottom of the test piece was then fixed to the tensilone. Afterward, the test piece was pulled at a tensile velocity of 500 mm/min and a chart velocity of 50 mm/min. The indicated load values (kg) when the meshes of network structure of the test piece torn off were measured. The adhesive strength (kg) was represented by an average value of the measured values.

TABLE 1

| Example | Qty. of Material (RPP/PE) | Film Fabric. Prop. | Fibrillating Prop. | Tensile Strength (kg/5 cm) | Elongation (%) | Adhesive Strength (kg) |
|---|---|---|---|---|---|---|
| 1 | 100/0 | x | x | 29.5 | 18 | 2.6 |
| 2 | 95/5 | o | Δ | 30.0 | 18 | 3.1 |
| 3 | 90/10 | oo | oo | 30.6 | 18 | 5.8 |
| 4 | 80/20 | oo | oo | 30.5 | 18 | 8.0 |
| 5 | 70/30 | o | o | 29.7 | 17 | 3.2 |
| 6 | 65/35 | o | x | 28.0 | 16 | 2.5 |

As shown in the above Table 1, the non-woven fabric in Examples 2 to 5 using the adhesive layer according to the present invention were excellent in all the film fabricating property, fibrillation property, tensile strength and adhesive strength.

EXAMPLE 7

A longitudinal web of Example 3 and a transversal web having the same composition as the one in Example 3 were crosswise laminated in accordance with a procedure in FIG. 9 to obtain a non-woven fabric (B). The tensile strength, elongation and adhesive strength of the thus obtained non-woven fabric (B) were 32 kg/per 5 cm width, 18% and 6 kg, respectively.

EXAMPLE 8

In a film fabricating step shown in FIG. 7, adhesive layers comprising a composition obtained by mixing propylene-ethylene random copolymer (trademark: Chisso Polypro FK 841, made by Chisso Corporation) and high-density polyethylene (density=0.956 g/cm$^3$, MFR=1.0 g/10 min, trademark: Nisseki Staflene E 710, made by Nippon Petrochemicals Co., Ltd.) in a blending ratio of 80/20 were laminated on both surfaces of a core layer comprising a polypropylene (density=0.90 to 0.91 g/cm$^3$, MFR=1.8 g/10 min, trademark: Nisseki Polypro E 120G, made by Nippon Petrochemicals Co., Ltd.) containing 1% of a pigment master batch (the concentration of green pigment=60%) by a multi-layer water cooling blown film extrusion method to form a multi-layer film of a three-layer structure having a thickness ratio of adhesive layer 25 μm/core layer 100 μm/adhesive layer 25 μm and a width of 1 m. At this time, the degree of soiling of the die lip was observed. In the next orientation step, the multi-layer film was oriented 9 times at a predetermined temperature with being moved forth. After that, in a fibrillating step, the multi-layer film was treated by a rotary fibrillator described in Japanese Utility Model Publication No. 51-38979 (1976) at a running velocity of 80 m/min to form numerous slits in a longitudinal direction in a cross-stitch pattern, thereby preparing a longitudinally monoaxially oriented reticular web having a length of 20,000 m. The fibrillating properties of the web were observed. As a result, the frequency of the cleaning of a die was 3 to 4 times per 250 hours, and the number of small splits or skipped splits in the fibrillating process were about 0 to 1/5000 m.

EXAMPLE 9

A pigment master batch (concentration of green pigment=60%) was added to a composition obtained by mixing propylene-ethylene random copolymer and high-density polyethylene of Example 8 in a ratio of 80/20, and evaluation was then carried out. As a result, the cleaning of a die was required once per 8 hours, and numerous small splits or skipped splits in the fibrillating were present all over the surface of the web and oversized splits were also present. The web had no commercial value.

EXAMPLES 10 and 11

In place of a pigment master batch of Example 8, 1000 ppm of a hindered amine weatherproofing agent was added. The effect of the weatherproofing agent was evaluated by a sunshine carbon arc lamp type weatherproofing test (test method: JIS B 7753-1977), and the results are shown in Table 2 and FIG. 10. Furthermore, in Example 11, no weatherproofing agent was added, and weatherproofing properties were then evaluated.

TABLE 2

| Duration | Strand Strength Retained (%) | | Elongation Retained (%) | | Adhesive Strength Retained (%) | |
|---|---|---|---|---|---|---|
| (Hr) | Ex. 10 | Ex. 11 | Ex. 10 | Ex. 11 | Ex. 10 | Ex.11 |
| 0 | 100 | 100 | 100 | 100 | 100 | 100 |
| 300 | 88 | 77 | 72 | 81 | 100 | 72 |
| 600 | 86 | 50 | 68 | 77 | 100 | 41 |
| 900 | 81 | 14 | 63 | 9 | 100 | 9 |
| 1200 | 77 | 12 | 63 | 6 | 100 | 6 |
| 1500 | 72 | 4.5 | 59 | 4.5 | 81 | 4.5 |
| 1800 | 63 | 3.6 | 50 | 3.6 | 54 | 2.7 |

Figure 10:
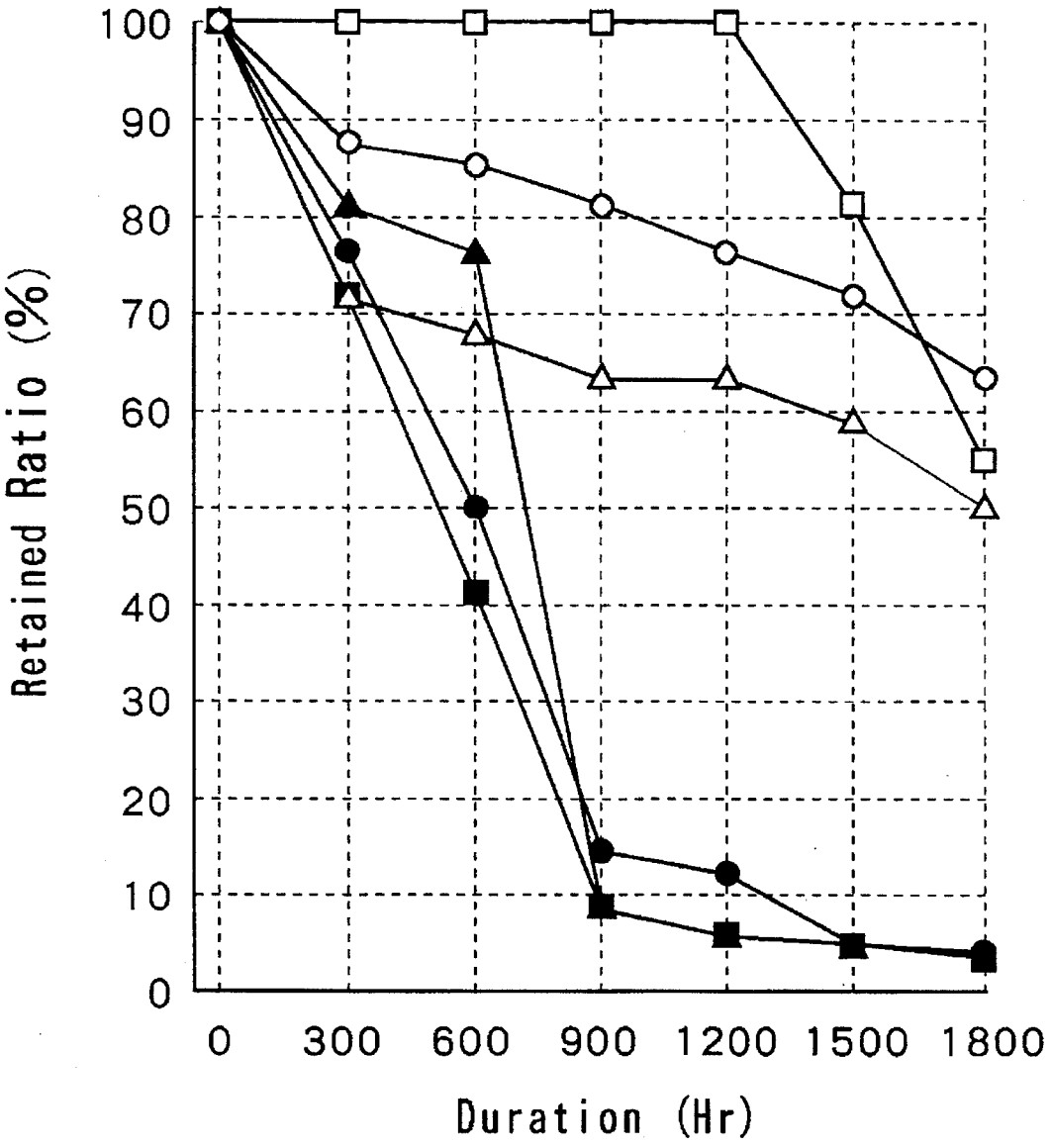
FIG. 10 is a graphic chart showing the evaluation results in weather resistance tests in Example 10 and Example 11.

As being understood from both the Table 2 and FIG. 10, the weather resistances in view of retained percentages of strand strength, elongation and adhesive strength in Example 10 according to the present invention were more than 50% even after 1800 hours, meanwhile these properties in Example 11 in which no weatherproofing agent was added, were lowered with the passage of time.

EXAMPLES 12 to 17

The reticular non-woven web (A) prepared above was laminated with the following base material. When the base material was not polypropylene type, both the web and the base materials were subjected to corona discharge treatment to obtain a surface tension of 42 dyne or above. In the case of polypropylene type material being used, both the web and the base material were not subjected to corona discharge treatment. The web and the base material were then thermally bonded at a heating cylinder temperature of 140° C. After that, the adhesive strengths of the obtained laminates were measured, the results of which are shown in the following Table 3.

Base materials

Paper

76 KP (kraft paper)

Span bond non-woven fabric

Sintex (PP) (trademark, made by Mitsui Petrochemical Industries, Ltd.)

Melt blow non-woven fabric

Shanfine (PP) (trademark, made by Toyobo Co., Ltd.)

Microporous film (1)

Espoal (LLDPE) (trademark, made by Mitsui Toatsu Chemicals, Inc.)

Microporous film (2)

Eleven (HDPE) (trademark, made by Tokai Pulp Co., Ltd.)

The tests were carried out as follows.

(1) Adhesive strength (g/20 mm width)

The laminate was cut to prepare some test pieces (width=20 mm, length=100 mm), and one end of each test piece was peeled off as long as about 30 mm by hands. Both peeled ends of the test piece were gripped by the grippers of a tensilone, and the 180° peeling strength of the test piece was measured at a tensile velocity of 300 mm/min.

It will be understood from the following Table 3 that the adhesive strengths in Examples 13 to 16 according to the present invention were larger in comparison with other Examples of 12 and 17.

TABLE 3

(Adhesive Strength (g/20 mm width))

| | Example | | | | | | Corona Discharge |
|---|---|---|---|---|---|---|---|
| | 12 | 13 | 14 | 15 | 16 | 17 | Treatment |
| RPP (wt. %) | 100 | 95 | 90 | 80 | 70 | 65 | |
| HDPE (wt. %) | 0 | 5 | 10 | 20 | 30 | 35 | |
| Paper | 120 | 170 | 220 | 260 | 210 | 190 | Yes |
| SBF | B.M. Brkn. | B.M. Brkn. | B.M. Brkn. | B.M. Brkn. | B.M. Brkn. | 320 | No |
| MBF | B.M. Brkn. | B.M. Brkn. | B.M. Brkn. | B.M. Brkn. | B.M. Brkn. | 280 | No |
| MCP (1) | 100 | 170 | 350 | 410 | 320 | 210 | Yes |
| MCP (2) | 70 | 140 | 360 | 430 | 330 | 250 | Yes |

Notes:
RPP: Propylene-ethylene random copolymer
HDPE: High density polyethylene
SBF: Spanbond non-woven fabric
MBF: Melt-blown non-woven fabric
MCP: Microporous film
B.M. Brkn: Base material was broken owing to larger adhesive force

What is claimed is:

1. A monoaxially oriented material comprising a propylene resin layer and at least one adhesive layer laminated to at least one surface of said polypropylene resin layer, said adhesive layer comprising 70% to 95% by weight of a propylene-ethylene random copolymer and 5% to 30% by weight of polyethylene having a density of at least 0.94 g/cm$^3$.

2. A material in accordance with claim 1 wherein said monoaxially oriented material is selected from the group consisting of a longitudinally monoaxially oriented reticular web, a transversely monoaxially oriented reticular web and a monoaxially oriented multilayered tape.

3. A propylene non-woven fabric comprising a crosswise laminate of said monoaxially oriented material of claim 1.

4. A non-woven fabric in accordance with claim 3 wherein said monoaxially oriented material is selected from the group consisting of a longitudinally monoaxially oriented reticular web, a transversely monoaxially oriented reticular web and a monoaxially oriented multilayered tape.

5. A woven fabric comprising a laminate of said monoaxially oriented multilayered tape of claim 2.

6. A monoaxially oriented material in accordance with claim 1 wherein said polypropylene resin layer includes at least one additive selected from the group consisting of a weatherproofing agent, a pigment and a filler.

7. A monoaxially oriented material in accordance with claim 1 wherein said monoaxially oriented material is oriented at an orientation ratio in the range of 1.1 to 15.

8. A monoaxially oriented material in accordance with claim 1 wherein said polypropylene resin layer thickness is in the range of 20 to 100 microns and said adhesive layer thickness is in the range of 3 to 60 microns.

9. A heat-resistant reinforced laminate material comprising the product obtained by laminating a base material and a monoaxially oriented material, said monoaxially oriented material comprising a polypropylene layer and at least one adhesive layer laminated to at least one surface of said polypropylene resin layer, said adhesive layer comprising 70% to 95% by weight of a propylene-ethylene random copolymer and 5% to 30% by weight of polyethylene having a density of at least 0.94 g/cm$^3$.

10. A heat-reinforced laminate material in accordance with claim 9 wherein said base material is selected from the group consisting of paper, plastic film or sheet, woven fabric, non-woven fabric and foil.

* * * * *